US005358231A

United States Patent [19]

Andela, deceased

[11] Patent Number: 5,358,231

[45] Date of Patent: Oct. 25, 1994

[54] SHEET HANDLING SYSTEM HAVING A SHEET CORRUGATION NIP

[75] Inventor: Jeffrey L. Andela, deceased, late of Sodus, N.Y., by Christine R. Andela, executrix

[73] Assignee: Xerox Corporation, Stamford, Conn.

[21] Appl. No.: 175

[22] Filed: Jan. 4, 1993

[51] Int. Cl.[5] ..... B65H 29/00

[52] U.S. Cl. ..... 271/176; 271/188; 271/209; 271/265; 271/273

[58] Field of Search ..... 271/188, 209, 161, 273, 271/274, 265, 176

[56] References Cited

U.S. PATENT DOCUMENTS

| | | | |
|---|---|---|---|
| 4,875,670 | 10/1989 | Petersen | 271/265 |
| 4,884,794 | 12/1989 | Dinafale et al. | 271/3 |
| 5,098,078 | 3/1992 | Nakanishi | 271/265 X |
| 5,153,663 | 10/1992 | Bober et al. | 355/319 |

OTHER PUBLICATIONS

Williams, Terrence E., "O Ring Document Corrugator" *Xerox Disclosure Statement,* vol. 8, No. 3 May/Jun. 1983.

*Primary Examiner*—Richard A. Schacher

[57] ABSTRACT

A corrugating roller assembly for use in sheet handling systems for advancing sheets along a path comprising a belt supported for rotation and rollers positioned adjacent the belt to form a corrugation nip with the belt. The device further includes apparatus for allowing the belt to move from a first sheet receiving position to a sheet corrugating position so that the leading edge of a sheet advancing along the path engages the belt and is guided thereby into the corrugation nip which includes the belt. The assembly further includes apparatus for actuating the rollers to drive the sheet through the corrugation nip.

11 Claims, 4 Drawing Sheets

SHEET HANDLING SYSTEM HAVING A SHEET CORRUGATION NIP

The present invention relates to sheet handlers, generally, and more particularly, to sheet handlers having a sheet corrugation nip.

U.S. Pat. No. 4,884,794 is hereby incorporated herein by reference thereto.

BACKGROUND OF THE INVENTION

In sheet handlers, including document handlers, there often exists a need to transport sheets across an unsupported distance or an area where the beam strength of the sheets transported may be problematic (e.g., resulting in jams, wrinkling of the sheet, and the like). In such instances it is well known to employ a corrugation roll or other known apparatus for permitting the desired operation. A corrugation roll is essence is an arrangement of rollers where, generally, a roller (rollers are) is supported along and rotated about one axis and opposed rollers are disposed along another axis to form a nip which, as a sheet passes therebetween, tends to corrugate the sheet.

Devices of this type and sheet handling systems employing them have proven to be generally effective and efficient. However, in certain applications sheet handlers employing corrugating rollers have some short comings. This is particularly true in cases where the corrugating rolls must be disposed adjacent or proximate a bend or curved section of a sheet path. In these cases, sheets in the path are not as adequately controlled as in straight sheet paths. Further, the nip of a corrugating roller set is not as well defined as a set of opposed rollers. Thus, sheets directed toward a corrugating nip can in some cases reach the nip above the desired entrance which generally results in an audible noise or clack, which is undesirable. In other cases, where the sheet directed toward the nip is low, the sheet can fail to be transported therethrough. In either case, too high or to low, the transported sheets can jam and/or otherwise be damaged (e.g., wrinkled), which is, of course, undesirable. It will be understood by those skilled in the art that reaching the nip high, so long as not too high, is generally more desirable as the upper rolls tend to direct the sheet into the nip, although the clack noise, previously noted, is still a problem which is generally annoying to those using the device, as well as those near the device.

The following patents may be relevant to the present invention:

U.S. Pat. No. 5,153,663 Patentee: Bober et al. Issued: Oct. 6, 1992

U.S. Pat. No. 4,884,794 Patentee: Dinatale et al. Issued: Dec. 5, 1989

Xerox Disclosure Journal Vol. 8, No. 3, pp. 191–192 Author: Terrence E. Williams Entitle: O RING DOCUMENT CORRUGATOR Dated: May/-June 1983

The discharges of these patents may be briefly summarized as follows:

U.S. Pat. No. 5,153,663 discloses a printing apparatus employing compliant sheet corrugating device. The corrugating device disclosed includes a compliant roll that is effective with low weight paper so that such paper is corrugated as it passes through the corrugation nip. The roll, due to its compliant nature, does not, however, corrugate paper having a high beam strength.

U.S. Pat. No. 4,884,794 discloses a reciprocating, recirculating document handler for feeding documents to an image processing station to record the information on the document. The handler includes a belt, which is operable in two directions and which is urged into position by backup rollers. The belt is provided for transporting the documents onto and off of a platen. Apparatus is also provided for inverting the transported documents so that the information on both sides of the document may be recorded and for permitting recirculation of the documents in a simplex and duplex manner.

Xerox Disclosure Journal, Vol. 8, No. 3, pp. 191–192, discloses an "O" ring document corrugating device employing three or more sets of pulleys which are provided to entrain an "O". The sets are arranged with at least two in one plane and a third set in another plane so that the "O" rings entrained thereon form a gradually converging and then interdigitated arrangement. Sheets are acquired along the converging portion and then pass through the interdigitated portion for corrugation.

In accordance with one aspect of the present invention, there is provided sheet handling apparatus for transporting sheets along a path, comprising means for corrugating sheets, and means for receiving a sheet transported along the path, the receiving means responsive to receiving a sheet transported along the path, cooperating with the corrugating means to form a corrugating nip for corrugating the sheet. The receiving means of this aspect of the invention may comprise one or more of the following elements a plurality of spaced belts adapted to engage the sheet being transported along the path to guide the sheet toward the corrugating nip and means responsive to the sheet engaging said belt, for pivoting the belts from a sheet receiving position to a sheet corrugating position. The corrugating means of this aspect of the invention may comprise a plurality of spaced rolls interdigitated with the belts in the sheet corrugating position to form the corrugating nip. Means for driving the rolls to urge the sheet through the corrugation nip can also be included in this aspect of the invention.

In accordance with another aspect of the present invention there is provided a corrugating roller assembly for use in sheet transports in which sheets are transported along a path, which comprises a belt assembly, a plurality of spaced rolls supported rotatably adjacent the belt assembly, and means for urging the belt assembly from a first position, for receiving the sheet being transported along the path to a second position wherein the belt assembly engages the plurality of spaced rolls to form a corrugating nip for corrugating the sheet. The belt assembly of this aspect of the invention may comprise a plurality of spaced pivotably supported belts mounted on the support so that the leading edge of sheet moving along the path engages the plurality of belts to pivot the support so as to move the plurality of belts from the first position to the second position. This aspect also includes interdigitating the plurality of rollers between the plurality of belts to form the corrugation nip.

According to yet another aspect of the present invention, a method for corrugating sheets is provided. The method comprises the steps of: positioning a belt in a first position for engaging a sheet; transporting a sheet into engagement with the belt; moving the belt from the first position to a second position in response to engagement of a sheet with the belt; forming a corrugation nip between the belt in the second position and rolls supported adjacent the belt; and urging the sheet through the corrugation nip. The moving step of the present invention according to this method can further include pivoting the belt in response to the sheet engaging the belt to move the belt from the first position to the second position wherein the pivoting step includes guiding the sheet into the corrugation nip. The urging step of this aspect can include driving the rolls to urge the sheet through the corrugation nip.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION

Figure 5:
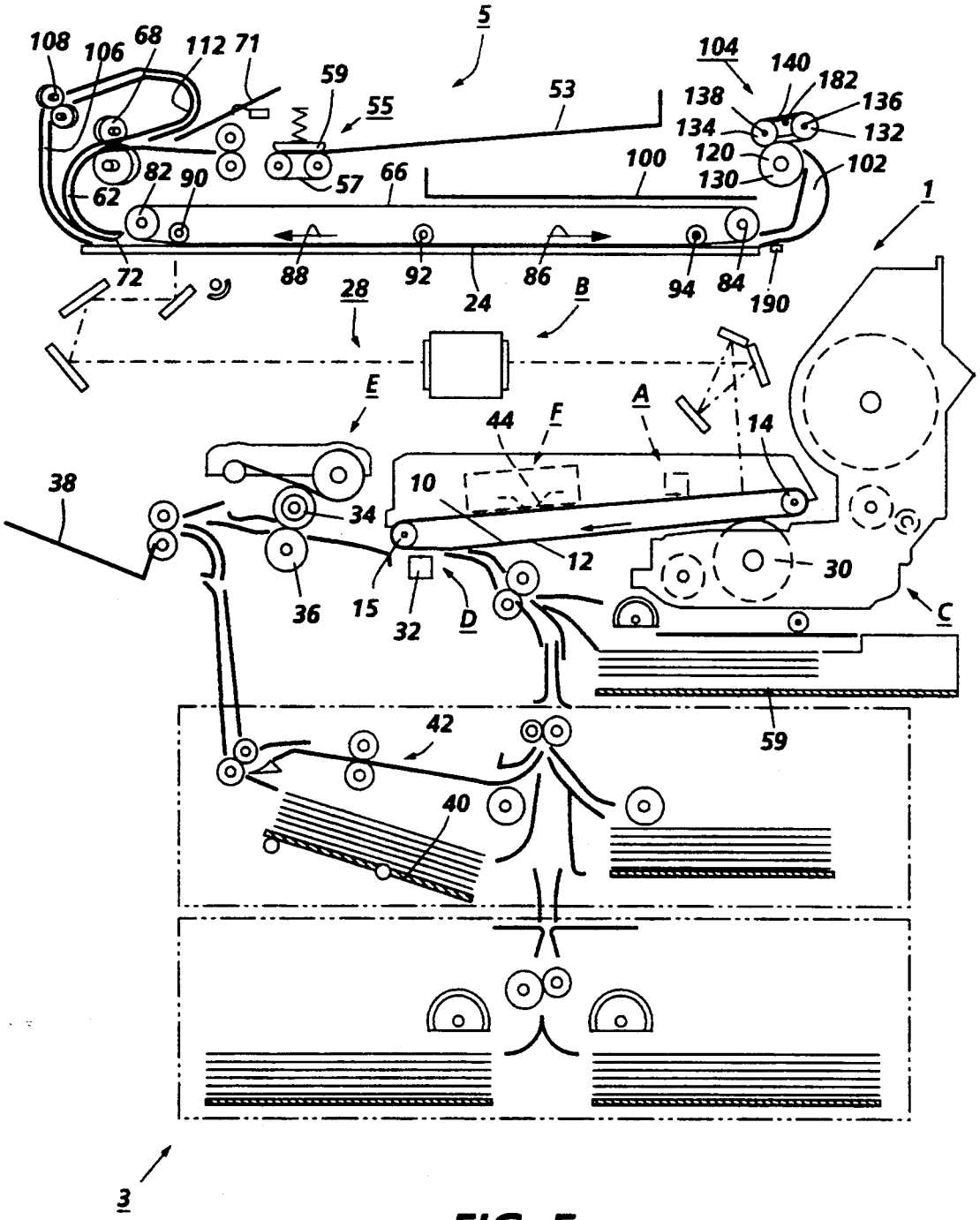
FIG. 5 is a schematic elevational view depicting an illustrative electrophotographic printing machine incorporating the document handler system of the present invention.

FIG. 5 schematically depicts an illustrative electrophotographic printing machine of the type in which the present invention may be employed. Specifically, the printing machine 1 of FIG. 5 has both a copy sheet handling system 3 and a document handling system 5 for transporting sheets of material such as paper, Mylar and the like, to and from processing stations of the machine 1. The machine 1, has conventional imaging processing stations associated therewith, including a charging station A, an imaging/exposing station B, a development station C, a transfer station D, a fusing station E, and a cleaning station F. It will be understood that a conventional finishing station (not shown) could easily be included in the machine. The machine I has a photoconductive belt 10 with a photoconductive layer 12 which is supported by a drive roller 14 and a tension roller 15. The drive roller 14 functions to drive the belt in the direction indicated by arrow 18. The drive roller 14 is itself driven by a motor (not shown) by suitable means, such as a belt drive.

The operation of the machine 1 can be briefly described as follows:

The photoconductive belt 10 is charged at the charging station A by a corona generating device 20. The charged portion of the belt is then transported by action the drive roller 14 to the imaging/exposing station B where a latent image is formed on the belt 10 corresponding to the image on a document positioned on a platen 24 via the light lens imaging system 28 of the imaging/exposing station B. It will also be understood that the light lens imaging system can easily be changed to an input/output scanning terminal or an output scanning terminal driven by a data input signal to likewise image the belt 10.

The portion of the belt 10 bearing the latent image is then transported to the development station C where the latent image is developed by electrically charged toner material from a magnetic developer roller 30 of the developer station C. The developed image on the belt is then transported to a transfer station D where the toner image is transferred to a copy sheet substrate transported in the copy handling system 3. In this case, a corona generating device 32 is provided to attract the toner image from the photoconductive belt 10 to the copy sheet substrate. The copy sheet substrate with image thereon is then directed to the fuser station E. The fuser at station E includes a heated fuser roll 34 and backup pressure roll 36. The heated fuser roll and pressure roll cooperate to fix the image to the substrate. The copy sheet then, as is well known, may be selectively transported to an output tray 38 or along a selectable duplex path (i.e., tray 40 and path 42 in the case of the illustrative printing machine of FIG. 4) for duplexing. The portion of the belt 10 which bore the developed image is then advanced to the cleaning station F where residual toner and charge on the belt is removed by a blade edge 44 and a discharge lamp (not shown). The cycle is then repeated.

Figure 1:
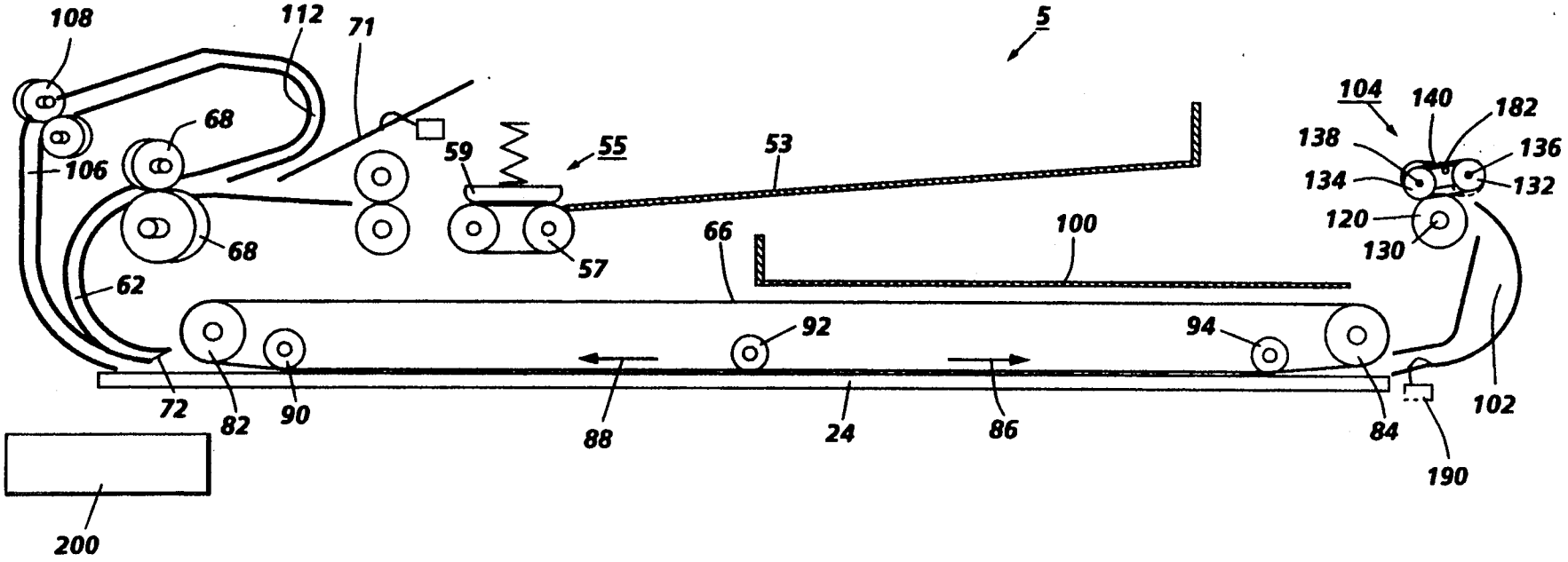
FIG. 1 is an enlarged elevational view of a document handler system incorporating the features of the present invention therein;.
Figure 1A:
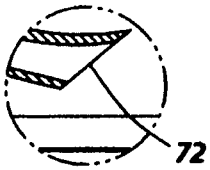
FIG. 1A is an enlarged, fragmentary elevational view, partial in section, of a portion of the document handler system of FIG. 1.

The invention will now be discussed in greater detail with respect to FIG. 1 and 1A, which represents a document handling system 5 for feeding documents from an input tray 53 to an imaging platen 24 of the type used in electrophotographic printing machines, as well as image input scanning devices. In this instance, documents are feed sequentially from a stack of document sheets (not shown) disposed in the tray 53 by the retard feed device 55 which includes the driven belt 57 and the pressure member 59 so that individual documents are feed from the bottom of the stack.

Documents fed by the retard feed device 55 are directed along an input path 62 toward a transport belt 66. A set of cross rollers 68 assist the transport of document along path 62 and also urge the registration of the fed documents along a lateral registration edge (not shown). A gate 72 which is biased to the closed position is positioned at the base of the path 62 and the entrance to belt transport 66. The gate 72 is of the type which permits the relatively uninhibited passage of documents from the path 62 to the belt 66 but which resists the passage of documents from the belt 66 to the path 62, as more fully explained below. In this case, documents may also be inserted in the document path 62 and transported to the belt transport 66 via cross-rollers 68 by a bypass shelf 71.

The transport belt 66 is entrained about a tension roller 82 and a drive roller 84. The drive roller is driven by a drive means (not shown) suitably connected so that the belt may be driven in the forward direction indicated by arrow 86 and in the reverse direction indicated by arrow 88. Thus, as a document enters the imaging area, the belt transport 66 is driven in the forward direction indicated by the arrow 86 to urge the document, onto the platen 24. Backup or pressure rollers 90, 92, and 94 are provided to urge the belt transport into closer proximity with the platen to assist transport of the document.

Ordinarily, during processing the belt 66 is usually stopped, the belt 66 is restarted in the direction of arrow 86 to urge the document toward the output tray 100 along the output path 102 via exit corrugating assembly, indicated generally by the reference numeral 104. However, in the document handling system depicted herein, often it is necessary to invert the document for return to the platen 24. In this instance, the depicted document handling system 5 is provided with an inversion path 106 so that documents directed off the platen 24 by the reverse rotation of the belt transport 66 in the direction of arrow 88 pass to the path 106. (As previously noted the gate 72 is positioned to oppose entry of such into the path 62). The inversion path 106 is provided with a roller set 108 for urging documents along the path toward and through a J-shaped baffle 112 to the cross-rollers 68 so that the document, now inverted, is directed to the belt transport 66 and the platen 24.

Figure 2A:
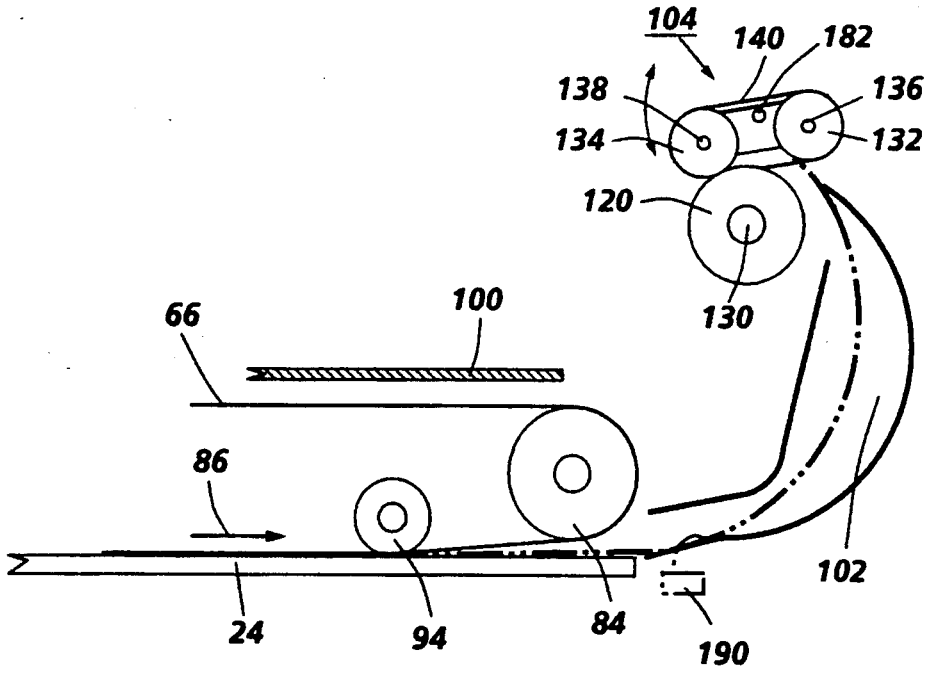
FIG. 2A is an enlarged, fragmentary elevational view, partial in section, of a portion of the document handler system of FIG. 1.
Figure 2B:
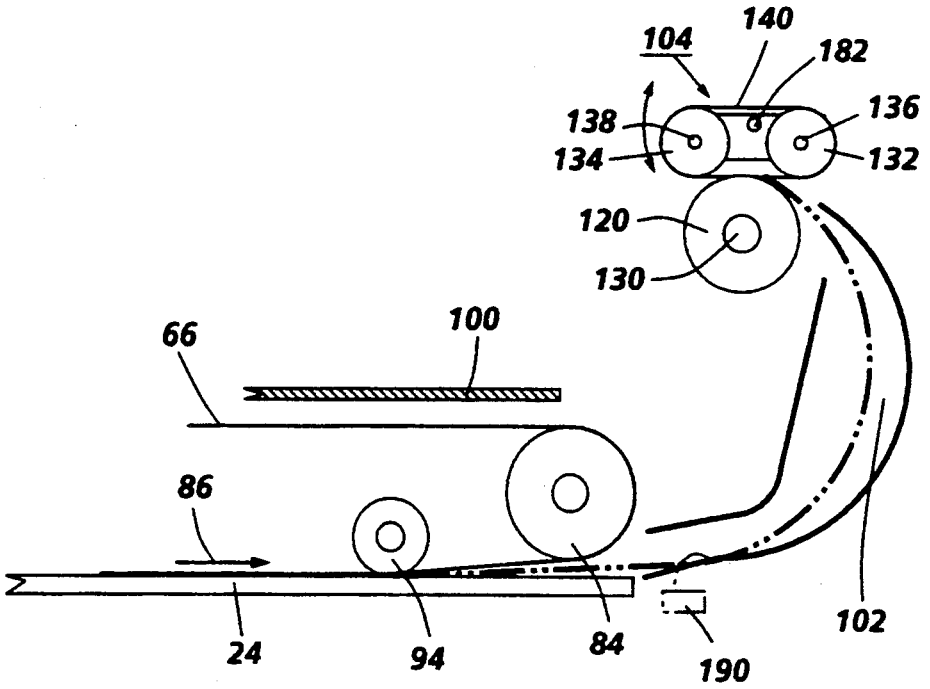
FIG. 2B is is an enlarged, fragmentary, elevational view, partial in section, of the portion of the document handling system of FIG. 2A illustrating the formation of a corrugating nip

Reference will now be made to FIGS. 1, 1A, 2B and 3 to explain and illustrate the corrugating nip assembly of the present unit. As seen in FIGS. 2A and 2B, the exit corrugating nip assembly 104 includes a first set of rolls 120 positioned on an axle 130, which in this case is rotationally actuated by a motor (not shown) suitably connected to the axle 130, such as a belt. A second and a third set of rollers 132 and 134 are positioned on axle members 136 and 138 for free rotation. Belts 140 are entrained about each of the sets of the rollers 132 and 134. The belts 140 are preferably formed in a flexible, compliant material, such as rubber or ENDUR C 300/20, manufactured by and available from Rodgers Corporation in South Windham, Conn., U.S.A.

Figure 3:
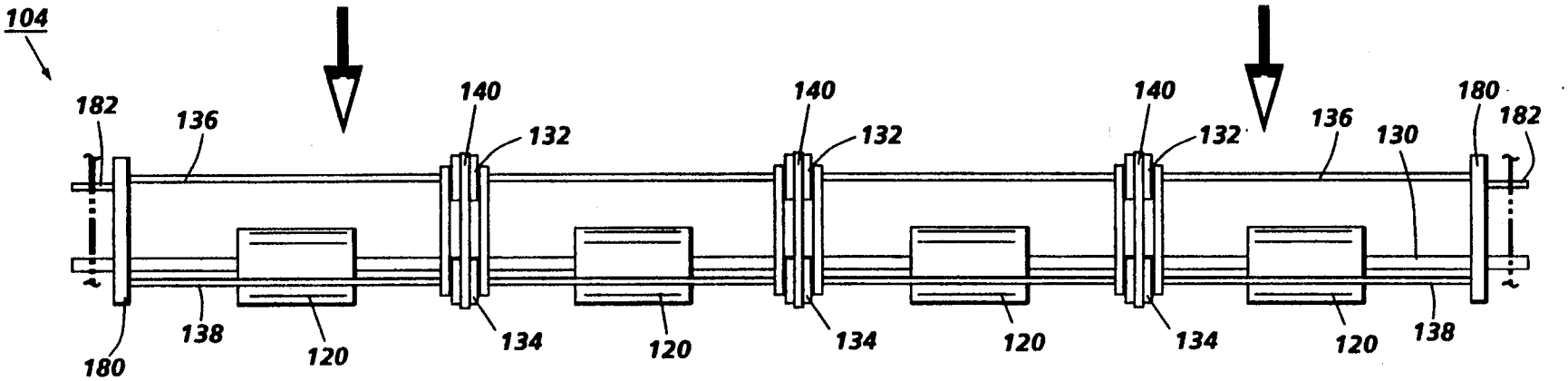
FIG. 3 is a plan view showing the rolls of the document handler system of FIG. 1.

Referencing now FIG. 3, it will be seen in this plan view, that yokes 180 are supported by a frame (not shown) of the document handler 5 for pivotal movement to enable the belts 140, in response to engagement with the leading edge of a transported document, to move from a first document receiving position to a document engaging position. Specifically, the yokes 180 support axle members 136 and 138 on which the rollers 132 and 134, respectively are rotationally mounted. The belts 140 are entrained on the rollers 132 and 134. Thus, the action of a document engaging the belt 140 is transmitted to the yokes 180.

It is preferred that the yokes are biased so that the first rollers in the path rollers 132, in this case) are positioned higher in the path so as to increase the width of the entrance to the corrugating nip. This can be accomplished by known spring devices and other biasing means. It is preferred, however, that the biasing of the yokes is accomplished using the weight of the corrugating apparatus. As seen in FIG. 3, the pivot mounts 182 on the yokes 180 are offset from the center of rotation so that the axle member 136 is higher than axle member 138, as seen in FIG. 2A. Thus, as a document engages the belt 140, the pivotally translation of the yokes 180 on the mounts 182 is urged and the corresponding translation of the belt forms the corrugation nip, as seen in FIG. 2B.

Figure 4:
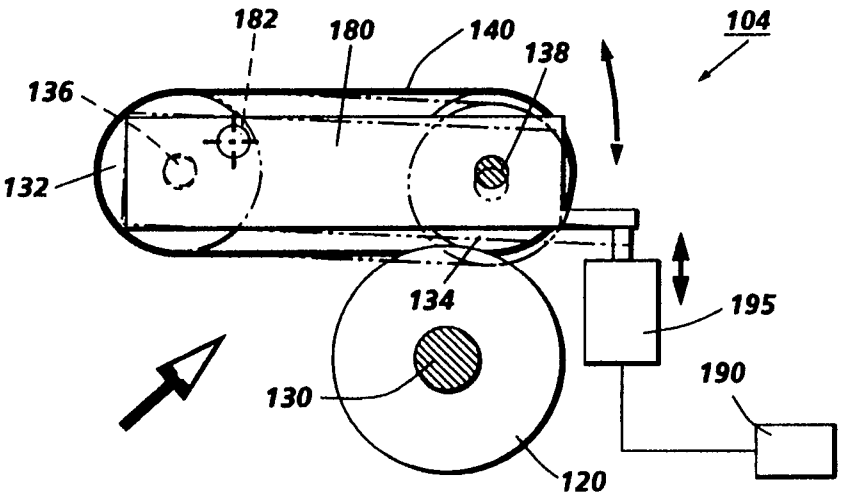
FIG. 4 is an enlarged, fragmentary, sectional, elevational view of a portion of the document handler incorporating the features of another embodiment of the present invention.

Thus, the mechanics of this see-saw type action are elementary to permit a cam-type action of the rollers 132 and 134 for the pivotal movement of the belts 140 depicted in FIGS. 2A and 2B. It will be understood that stops can be provided to limit the travel of the yolks 180, and thus, the belts 140. That is, a slight weight difference toward the side of the yoke 180 on which axle member 138 is supported to create a downward force to urge rotation on pivot mounts 182. It will be appreciated that the offset need not be great to accomplish this. Further, in many applications this is undesirable, as to create an offset would prevent rotation to the position depicted in FIG. 2B when a sheet of relative low beam strength was transported. An alternative to the embodiment described would be to include a micro switch 190 in the output path 102 (see FIGS. 2A and 2B) where the micro switch is shown in phantom lines). The tripping of the switch 190 (see FIGS. 2A and 2B) would actuate a solenoid 195 (see FIG. 4) which would push on one of the yokes 180 to move the belts 140 from the sheet receiving position to the corrugating position. In operation, a sheet after tripping the switch 190 would be received, at the belts 140 (see FIG. 2A) and, approximately concurrently therewith, the solenoid 195 is actuated to urge the portion of one of the yokes 180 proximate axle member 138 upward, as depicted in FIG. 4.

As will be also understood, the control signals for the document handler operation are provided by controller 200 which is preferably a conventional microprocessor system. It is contemplated that the controller controls all machine steps and functions described herein, as well as that of any and/or all apparatus and devices associated with the document handler, such as, for example, an electrophotographic printing machine.

It will be appreciated that the present invention can be employed with a document handler of the type disclosed and described herein. The present invention also may be incorporated and used in most sheet handling apparatus in which sheets are transported and, particularly, those which employ a corrugating devices. Thus, the present invention provides a relatively low cost corrugating nip, while reducing undesirable noise and also limiting the number of document jams and document damage.

It should be understood that in some cases, the belts 140 of the present invention are preferred to be entrained on rollers which are supported by a dedicated mounting. That is for example, the axles 136 and 138 would be shortened so as to support only one or several rollers 132 and 134, respectively, In turn, numerous mounts (e.g., one or two mounts for every set, when supporting one each of the rollers 132 and 134), like yokes 180 with pivot mounts 182, would be used. These mounts would preferably be suspended from a position (preferably the frame (not shown) of the document handler 5) displaced along an axis perpendicular to the drive roll axle. On this manner, the force to drive the corrugation nip from the first to the second position would be reduced, as the mass of each pivoting member would be less than the entire apparatus of the previously described embodiments. It will be also understood that the belts 140 can be eliminated and the engaging surface of the rollers 132 and 134 suitably covered in a sheet engaging material, such as disclosed above with respect to the belts 140, to form the upper engagement surfaces of the nip.

It will be further understood and appreciated that the features of the invention provides advantages by its use. The following is intended to be illustrative and not limiting. The invention provides a relatively wide receiving area for receiving documents and sheets transported to the nip. It further provides a guide to the nip. It also reduces noise, since the receiving surface is the compliant belt which tends to absorb the impact of the sheet. Another advantage includes the fact that relatively high beam strength paper can travel through the nip without damage due to the compliant nature of the nip formed by the roller and the belt. Other features not specifically recited herein or elsewhere in the foregoing will be obvious and are contemplated within the invention.

In recapitulation, a sheet handling apparatus for transporting sheets to and from a processing station along the path has been described. The apparatus comprises generally a mechanism for corrugating sheets comprising a corrugating nip, for receiving a sheet transported along the path, and for actuating said receiving means to form the corrugating nip. A corrugating roller assembly for use in sheet transports in which sheets are transported along a path has also been described. The assembly comprises a belt, a first roll and a second roll pair for supporting the belt, a third roll and a fourth roll supported for rotation adjacent said belt, and a mechanism for actuating the belt from a first sheet receiving position, for receiving the lead edge of a transported sheet and for guiding the sheet to a sheet corrugation nip.

It is, therefore, apparent that there has been provided in accordance with the present invention, a corrugating nip assembly, as well as a sheet handling device with a corrugating nip, that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. Sheet handling apparatus for transporting sheets along a path, comprising:

means for corrugating sheets; and means for receiving a sheet transported along the path, said receiving means responsive to receiving a sheet transported along the path, cooperating with said corrugating means to form a corrugating nip for corrugating the sheet, said receiving means comprises a plurality of spaced belts adapted to engage the sheet being transported along the path to guide the sheet toward the corrugating nip and means, responsive to the sheet engaging said belt, for pivoting said belts from a sheet receiving position to a sheet corrugating position.

2. An apparatus according to claim 1, wherein said corrugating means comprises a plurality of spaced rolls interdigitated with said belts in the sheet corrugating position to form the corrugating nip.

3. An apparatus according to claim 2, further comprising means for driving said rolls to urge the sheet through the corrugation nip.

4. A corrugating roller assembly for use in sheet transports in which sheets are transported along a path, comprising:

a belt assembly;

plurality of spaced rolls supported rotatably adjacent said belt assembly; and means for urging said belt assembly from a first position, for receiving the sheet being transported along the path to a second position wherein said belt assembly engages said plurality of spaced rolls to form a corrugating nip for corrugating the sheet.

5. The assembly of claim 4, wherein said belt assembly comprises:

a pivotably mounted support; and a plurality of spaced belts mounted on said support.

6. The assembly of claim 5, wherein the leading edge of sheet moving along the path engages said plurality of belts to pivot said support so as to move said plurality of belts from the first position to the second position.

7. The assembly of claim 6, wherein said plurality of rollers are interdigited between said plurality of belts to form the corrugation nip.

8. A method for corrugating sheets, comprising the steps of:

positioning a belt in a first position for engaging a sheet;

transporting a sheet into engagement with the belt;

moving the belt from the first position to a second position in response to engagement of a sheet with the belt;

forming a corrugation nip between the belt in the second position and rolls supported adjacent the belt; and urging the sheet through the corrugation nip.

9. The method of claim 8, wherein said moving step comprises pivoting the belt in response to the sheet engaging the belt to move the belt from the first position to the second position.

10. The method of claim 9, wherein said pivoting step includes guiding the sheet into the corrugation nip.

11. The method of claim 10, wherein said urging step comprises driving the rolls to urge the sheet through the corrugation nip.

* * * * *